US008434759B2

(12) United States Patent
Abe et al.

(10) Patent No.: US 8,434,759 B2
(45) Date of Patent: May 7, 2013

(54) SHEET TRANSPORT DEVICE AND IMAGE FORMING APPARATUS

(75) Inventors: Takashi Abe, Kanagawa (JP); Michio Tada, Kanagawa (JP); Yoshiyuki Takaishi, Kanagawa (JP); Yousuke Hasegawa, Tokyo (JP); Yoichi Yamakawa, Kanagawa (JP); Hisakazu Onoe, Kanagawa (JP); Makio Uehara, Kanagawa (JP); Yasunobu Gotoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/250,165

(22) Filed: Sep. 30, 2011

(65) Prior Publication Data

US 2012/0248679 A1 Oct. 4, 2012

(30) Foreign Application Priority Data

Mar. 29, 2011 (JP) ..... 2011-071691

(51) Int. Cl.
*B65H 7/02* (2006.01)

(52) U.S. Cl.
USPC ..... 271/243; 271/244; 271/245

(58) Field of Classification Search ..... 271/243, 271/244, 245, 246
See application file for complete search history.

(56) References Cited

U.S. PATENT DOCUMENTS

| | | | | |
|---|---|---|---|---|
| 5,039,086 | A * | 8/1991 | Matsuno et al. | 271/227 |
| 5,072,926 | A * | 12/1991 | Van Soest | 271/236 |
| 5,374,053 | A * | 12/1994 | Doucet et al. | 271/243 |
| 6,293,544 | B1 * | 9/2001 | Fedinatz | 271/243 |
| 6,712,355 | B2 * | 3/2004 | Nakaoda et al. | 271/236 |
| 6,755,411 | B2 * | 6/2004 | Janatka et al. | 271/2 |
| 7,467,793 | B2 * | 12/2008 | Tanabe | 271/245 |
| 7,588,239 | B2 * | 9/2009 | Marcinik et al. | 270/52.18 |
| 7,798,491 | B2 * | 9/2010 | Moteki et al. | 271/242 |

FOREIGN PATENT DOCUMENTS

| | | |
|---|---|---|
| JP | B2-4147182 | 6/2008 |
| JP | A-2009-221021 | 10/2009 |
| WO | WO 02/100647 A1 | 12/2002 |

* cited by examiner

*Primary Examiner* — Kaitlin Joerger
(74) *Attorney, Agent, or Firm* — Oliff & Berridge, PLC

(57) ABSTRACT

A sheet transport device includes an abutment member that moves downstream in a sheet transport direction and against which a leading end of a sheet that has been transported from upstream in the sheet transport direction abuts; and a transport unit that transports the sheet whose leading end has abutted against the abutment member further downstream. The abutment member moves at least to the transport unit in a state in which the leading end of the sheet abuts against the abutment member, and the abutment member is separated from the leading end of the sheet after the transport unit has started to transport the sheet.

8 Claims, 13 Drawing Sheets

SHEET TRANSPORT DEVICE AND IMAGE FORMING APPARATUS

CROSS-REFERENCE TO RELATED APPLICATIONS

This application is based on and claims priority under 35 USC 119 from Japanese Patent Application No. 2011-071691 filed Mar. 29, 2011.

BACKGROUND

Technical Field

The present invention relates to a sheet transport device and an image forming apparatus.

SUMMARY

According to an aspect of the invention, a sheet transport device includes an abutment member that moves downstream in a sheet transport direction and against which a leading end of a sheet that has been transported from upstream in the sheet transport direction abuts; and a transport unit that transports the sheet whose leading end has abutted against the abutment member further downstream. The abutment member moves at least to the transport unit in a state in which the leading end of the sheet abuts against the abutment member, and the abutment member is separated from the leading end of the sheet after the transport unit has started to transport the sheet.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiment(s) of the present invention will be described with reference to the drawings.

Figure 1:
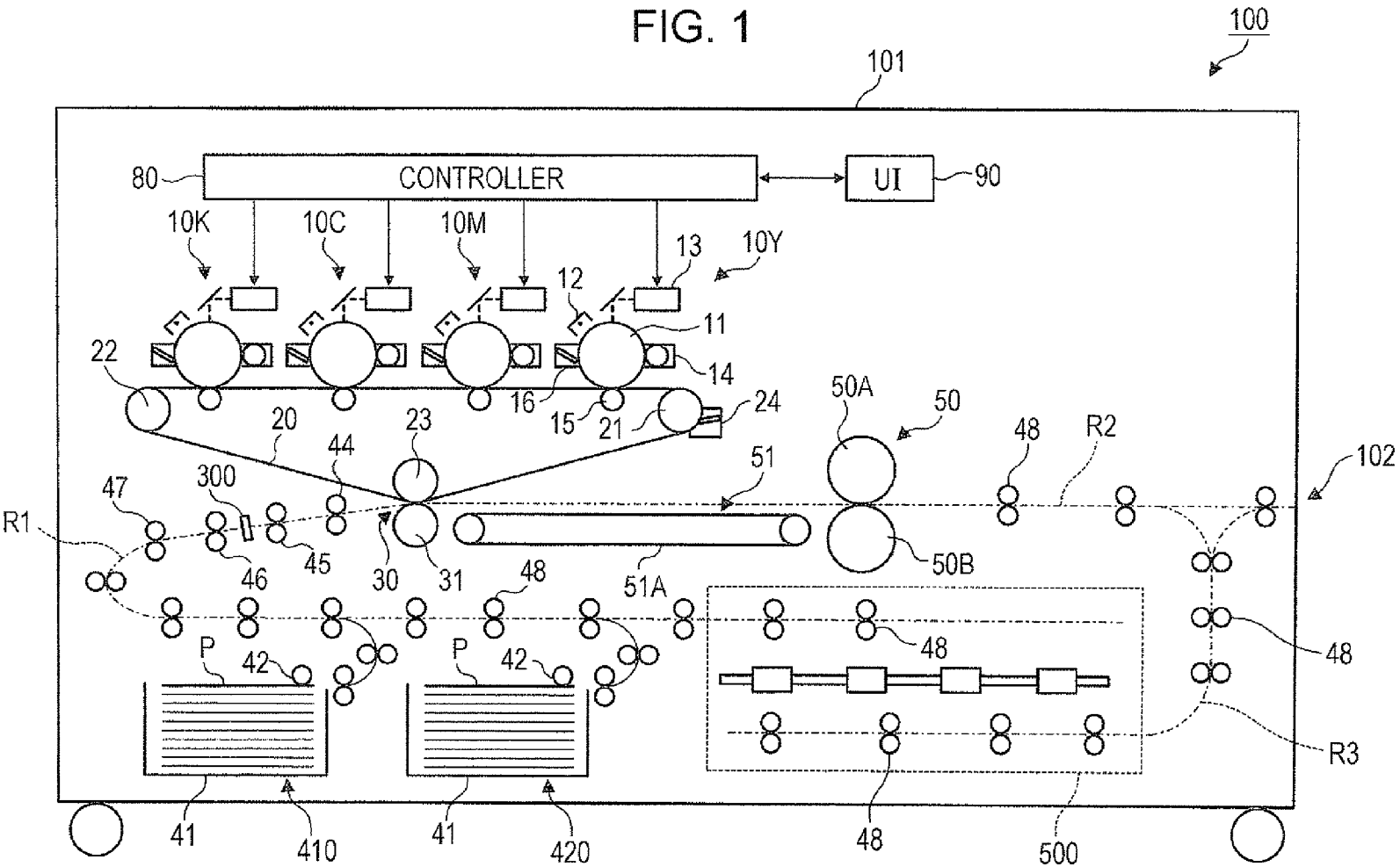
FIG. 1 illustrates an image forming apparatus according to an exemplary embodiment as seen from the front of the apparatus.

FIG. 1 illustrates an image forming apparatus according to an exemplary embodiment as seen from the front of the apparatus. An image forming apparatus 100 illustrated in FIG. 1 has a so-called tandem-type structure, and includes image forming units 10 (10Y, 10M, 10C, and 10K) that form color toner images in different colors. The image forming apparatus 100 according to the present exemplary embodiment includes a controller 80 that controls the operations of devices and units included in the image forming apparatus 100. The image forming apparatus 100 also includes a user interface (UI) unit 90 that has a display panel. The UI unit 90 outputs instruction received from a user to the controller 80, and provides the user with information received from the controller 80.

The image forming apparatus 100 includes an intermediate transfer belt 20 and a second-transfer device 30. The color toner images formed by the image forming units 10 are successively transferred (first-transferred) to the intermediate transfer belt 20 and are supported on the intermediate transfer belt 20. The second-transfer device 30 transfers (second-transfers) the toner images on the intermediate transfer belt 20 to the sheet P. Here, the image forming units 10, the intermediate transfer belt 20, and the second-transfer device 30 correspond to an image forming section that forms an image on a sheet P, which is an example of a recording medium. The image forming apparatus 100 includes a first sheet transport path R1, a second sheet transport path R2, and a third sheet transport path R3. The sheet P is transported toward the second-transfer device 30 along the first sheet transport path R1. After the sheet P has passed the second-transfer device 30, the sheet is transported along the second sheet transport path R2. The third sheet transport path R3 is split from the second sheet transport path R2 at a position downstream of a fixing unit 50 (described below) and extends to a position below the first sheet transport path R1.

The present exemplary embodiment includes a reversing mechanism 500 that transports the sheet P from the third sheet transport path R3 to the first sheet transport path R1 and that reverses the sheet P. In the present exemplary embodiment, an opening 102 is formed in a housing 101 of the image forming apparatus 100. The sheet P that has been transported along the second sheet transport path R2 is output to the outside of the housing 101 through the opening 102 and is stacked on a sheet tray (not shown). A finisher (not shown) may be disposed adjacent to the housing 101, and operations such as punching may be performed on the sheet P that has been output through the opening 102.

The image forming apparatus 100 includes a first sheet feeder 410 and a second sheet feeder 420. The first sheet feeder 410 feeds the sheet P to the first sheet transport path R1. The second sheet feeder 420 is disposed upstream of the first sheet feeder 410 in the transport direction of the sheet P, and feeds the sheet P to the first sheet transport path R1. The first sheet feeder 410 and the second sheet feeder 420 have substantially the same structure. Each of the first sheet feeder 410 and the second sheet feeder 420 includes a sheet container 41 that contains the sheet P and a pick-up roller 42 that picks up the sheet P contained in the sheet container 41 and that transports the sheet P.

A first transport roller 44 is disposed at a position above the first sheet transport path R1 and upstream of the second-transfer device 30. The first transport roller 44 transports the sheet P in the first sheet transport path R1 toward the second-transfer device 30. Moreover, a second transport roller 45 that transports the sheet P toward the first transport roller 44, a third transport roller 46 that transports the sheet P toward the second transport roller 45, and a fourth transport roller 47 that transports the sheet P toward the third transport roller 46 are also provided. In addition to these transport rollers, transport rollers 48 are disposed in the first sheet transport path R1, the second sheet transport path R2, and the third sheet transport path R3, and transport the sheet P along these paths.

In the present exemplary embodiment, abutment members 300 are disposed between the second transport roller 45 and the third transport roller 46. The abutment members 300 are made of a stainless steel, and a leading end of the sheet P abuts against the abutment members 300. In the present exemplary embodiment, the leading end of the sheet P abuts against the abutment members 300, and thereby skew of the sheet P (inclination of the sheet P with respect to the transport direction) is corrected. After the skew of the sheet P has been corrected by the abutment members 300, the abutment members 300 are retracted from the first sheet transport path R1. In the present exemplary embodiment, the fixing unit 50 is disposed in the second sheet transport path R2. The fixing unit 50 fixes the toner images, which have been second-transferred to the sheet P by the second-transfer device 30, to the sheet P.

A transport unit 51 is disposed between the second-transfer device 30 and the fixing unit 50. The transport unit 51 transports the sheet P that has passed the second-transfer device 30 to the fixing unit 50. The transport unit 51 includes a belt 51A that rotates, and transports the sheet P on the belt 51A. The fixing unit 50 includes a heating roller 50A and a press roller 50B. The heating roller 50A contains a heater (not shown) and is heated by the heater, and the press roller 50B presses the heating roller 50A. In the fixing unit 50, the sheet P is pressed and heated when the sheet P passes a nip between the heating roller 50A and the press roller 50B. Thus, the image on the sheet P is fixed to the sheet P.

Each of the image forming units 10 includes a photoconductor drum 11 that is rotatable. A charger 12, an exposure device 13, and a developing device 14 are disposed around the photoconductor drum 11. The charger 12 charges the photoconductor drum 11. The exposure device 13 exposes the photoconductor drum 11 to light and forms an electrostatic latent image. The developing device 14 makes the electrostatic latent image on the photoconductor drum 11 visible by using a toner. Moreover, a first-transfer device 15 and a drum cleaner 16 are provided. The first-transfer device 15 transfers the toner images in different colors formed on the photoconductor drum 11 to the intermediate transfer belt 20. The drum cleaner 16 removes remaining toner from the photoconductor drum 11.

The intermediate transfer belt 20 is looped over three rollers 21 to 23 and rotates. Among the three rollers 21 to 23, the roller 22 drives the intermediate transfer belt 20. The roller 23 is disposed so as to face a second-transfer roller 31 with the intermediate transfer belt 20 therebetween. The second-transfer roller 31 and the roller 23 constitute the second-transfer device 30. A belt cleaner 24 is disposed so as to face the roller 21 with the intermediate transfer belt 20 therebetween. The belt cleaner 24 removes remaining toner from the intermediate transfer belt 20.

The image forming apparatus 100 according to the present exemplary embodiment is not only capable of forming an image on one side of the sheet P that has been fed from the first sheet feeder 410 or the like but also capable of forming an image on the other side of the sheet P. To be specific, in the image forming apparatus 100, the sheet P that has passed through the fixing unit 50 is reversed by the reversing mechanism 500, and the reversed sheet P is transported to the second-transfer device 30 again. The second-transfer device 30 transfers an image to the other side of the sheet P. Subsequently, the sheet P passes through the fixing unit 50 again, and the transferred image is fixed to the sheet P. Thus, images are formed on both sides of the sheet P.

Figure 2:
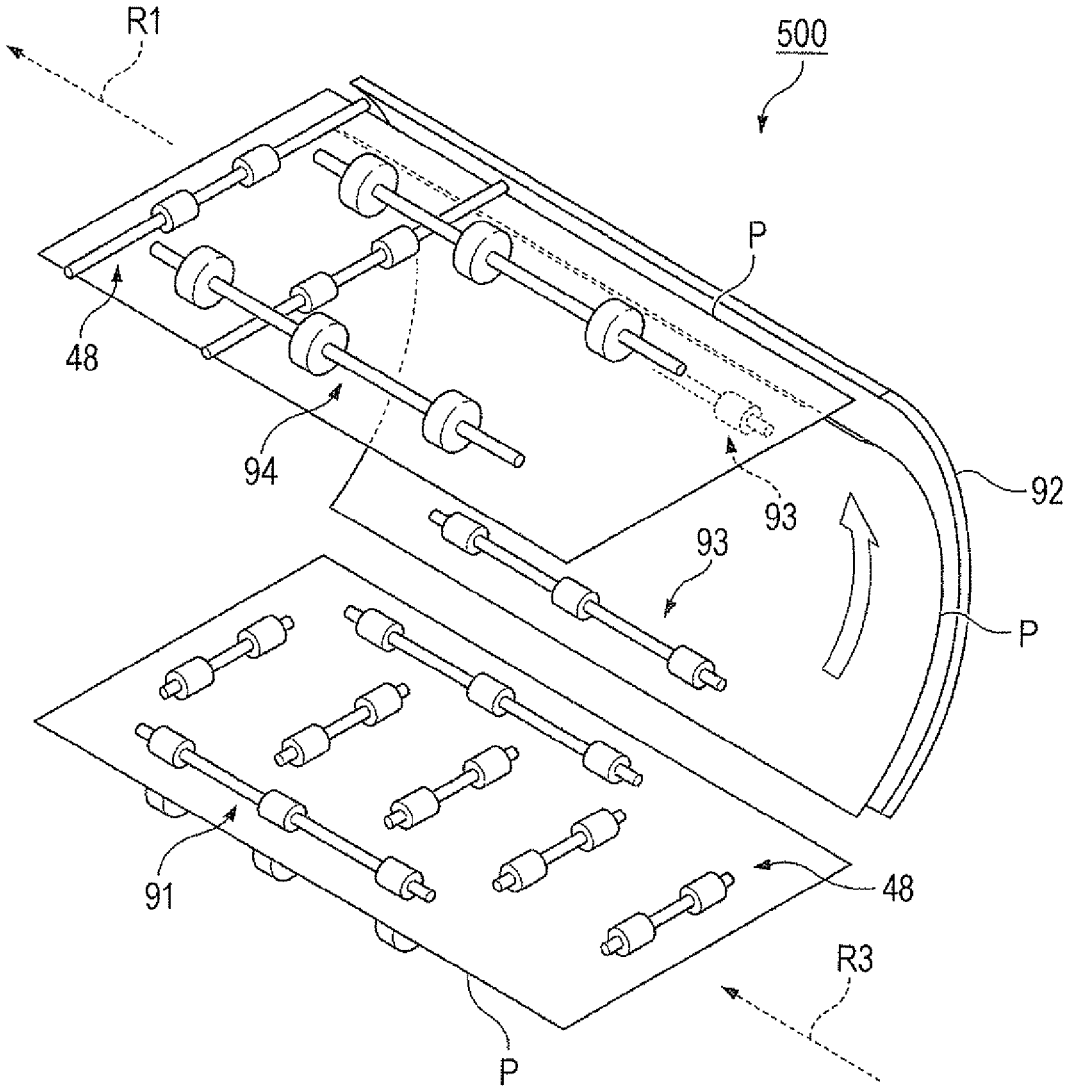
FIG. 2 illustrates a reversing mechanism.

FIG. 2 illustrates the reversing mechanism 500.

As described above, in the present exemplary embodiment, the transport rollers 48 are disposed in the third sheet transport path R3, and the transport rollers 48 transport the sheet P along the third sheet transport path R3. The transport rollers 48 are also disposed in the first sheet transport path R1, and the transport rollers 48 transport the sheet P along the first sheet transport path R1. Transport rollers 91 are disposed in the third sheet transport path R3, and the transport rollers 91 transport the sheet P in a direction that is perpendicular to (that intersects) a direction in which the sheet P is transported in the third sheet transport path R3. In other words, the transport rollers 91 transport the sheet P toward a side of the third sheet transport path R3.

The present exemplary embodiment further includes a guide member 92. The guide member 92 guides the sheet P so that the sheet P that has been transported by the transport rollers 91 is moved upward and so that the sheet P that has been moved upward is moved further toward the first sheet transport path R1. The present exemplary embodiment further includes transport rollers 93. The transport rollers 93 nip the sheet P that has been guided by the guide member 92 and whose leading end is oriented upward, and transport the sheet P further upward. Moreover, transport rollers 94 are disposed in the first sheet transport path R1. The transport rollers 94 transport the sheet P that has been transported by the transport rollers 93 to a predetermined position in the first sheet transport path R1.

Each of the transport rollers 48 includes a pair of roller members. The transport roller 48 rotates while nipping the sheet P between the pair of roller members, and transports the sheet P. Only one of the pair of roller members is illustrated in FIG. 2. Likewise, each of the transport rollers 91, the transport rollers 93, and the transport rollers 94 includes a pair of roller members, and transports the sheet while nipping the sheet P between the pair of roller members. In the present exemplary embodiment, one of the roller members of the transport roller 48 is separable from the other roller member. The same applies to the transport rollers 91 and the transport rollers 94, and one of the roller members is separable from the other roller member. Moreover, a separation mechanism (not shown) for separating one of the roller members from the other roller member is provided. The separation mechanism is composed of existing technical components such as a motor, a cam, and the like.

The sheet P is transported along the third sheet transport path R3 by the transport rollers 48 before the reversing mechanism 500 reverses the sheet P. At this time, one of the roller members of each of the transport rollers 91 that are disposed in the third sheet transport path R3 is separated from the other roller member. Next, one of the roller members of each of the transport rollers 48 is separated from the other roller member, and one of the roller members of each of the transport rollers 91 is pressed against the other roller member.

Next, the transport rollers 91, the transport rollers 93, and the transport rollers 94 are rotated, and the sheet P is transported toward the first sheet transport path R1. At this time, one of the roller members of each of the transport rollers 48 that are disposed in the first sheet transport path R1 is separated from the other roller member. When the sheet P is transported to a predetermined position in the first sheet transport path R1, rotations of the transport rollers 91, the transport rollers 93, and the transport rollers 94 are stopped. Subsequently, one of the roller members of each of the transport rollers 94 is separated from the other roller member, and one of the roller members of each of the transport rollers 48 that are disposed in the first sheet transport path R1 is pressed against the other roller member with the sheet P therebetween.

Next, the transport rollers 48 are rotated, and the sheet P is transported along the first sheet transport path R1. At this time, the sheet P has been already reversed. With the reversing mechanism 500 according to the present exemplary embodiment, the sheet P is reversed without interchanging the leading end of the sheet P in the transport direction with the trailing end. Instead, with the reversing mechanism 500 according to the present exemplary embodiment, one of the side edges of the sheet P (a side edge that is connected to the leading end and to the trailing end of the sheet P) is interchanged with the other side edge.

Figure 3A:
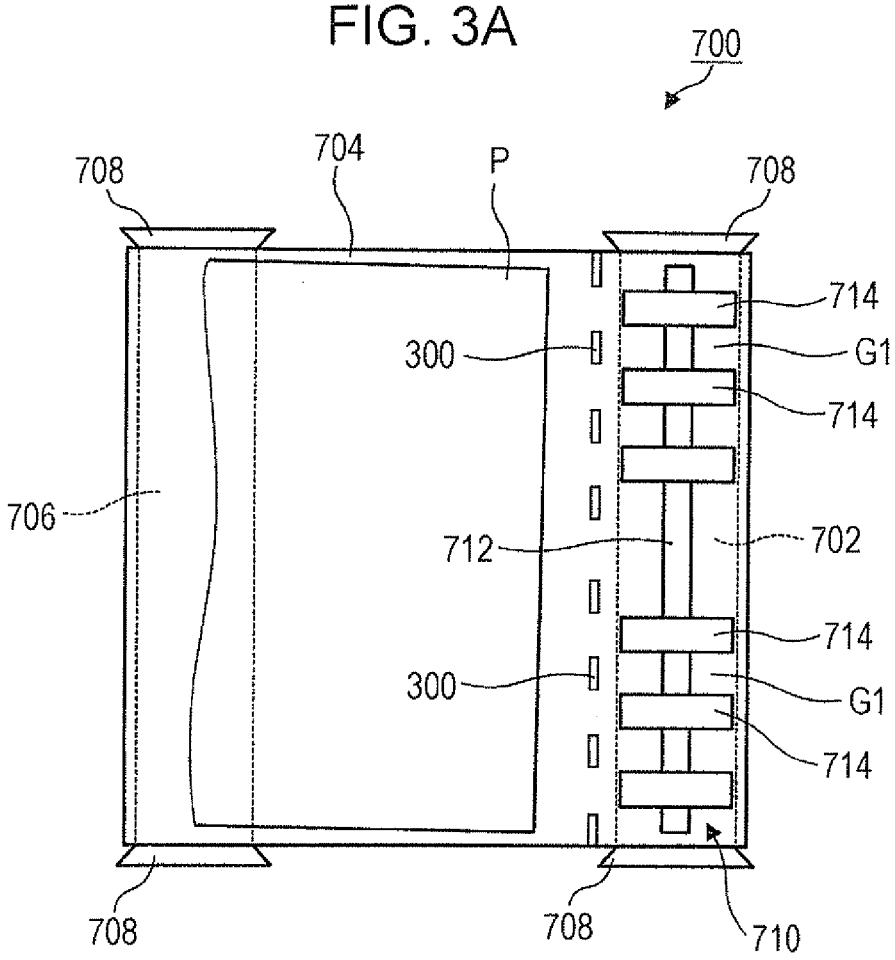
FIGS. 3A and 3B illustrate the structure of a mechanism including abutment members illustrated in FIG. 1 and other members.
Figure 3B:
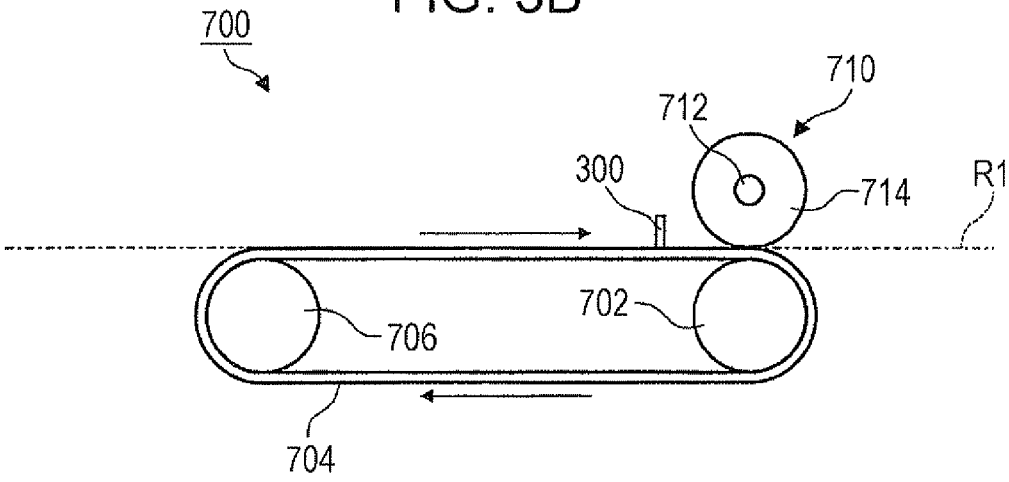

FIGS. 3A and 3B illustrate the structure of a mechanism including the abutment members 300 illustrated in FIG. 1 and other members. FIG. 3A is a plan view, and FIG. 3B is a side view.

Although not illustrated in FIG. 1, a movement mechanism 700 is disposed between the second transport roller 45 and the third transport roller 46 illustrated in FIG. 1. The movement mechanism 700 moves the abutment members 300 in the transport direction of the sheet P (along the first sheet transport path R1).

The movement mechanism 700 includes a drive roller 702, an endless belt 704, and a support roller 706. The drive roller 702 is rotated by a motor (not shown). The endless belt 704 receives a driving force from the drive roller 702 and rotates. The support roller 706 is disposed upstream of the drive roller 702 in the transport direction of the sheet P, applies a tension to the belt 704, and supports the belt 704 from the inside. In the present exemplary embodiment, the drive roller 702 is disposed downstream of the support roller 706 in the transport direction of the sheet P. In this case, the tension is applied to a part of the belt 704 that is located adjacent to the first sheet transport path R1, and thereby loosening or the like of a part of the belt 704 that contacts the sheet P is prevented.

In the present exemplary embodiment, as illustrated in FIG. 3A, flanges 708 are disposed at both ends of the drive roller 702 and at both ends of the support roller 706. The flanges 708 restrain movement of the belt 704 in the width direction of the belt 704 (direction perpendicular to the transport direction of the sheet P). The flanges 708 are not illustrated in FIG. 3B. In the present exemplary embodiment, the abutment members 300 are fixed to the outer peripheral surface of the belt 704 so as to protrude from the outer peripheral surface. As illustrated in FIG. 3A, the abutment members 300 are arranged at a predetermined pitch. The abutment members 300 are arranged in a direction perpendicular to the transport direction of the sheet P (the width direction of the belt 704).

The movement mechanism 700 further includes a driven roller 710. The driven roller 710 is pressed against the drive roller 702 with the belt 704 therebetween and is rotated by a driving force received from the belt 704. The driven roller 710 includes a rotary shaft 712 and contact members 714. The rotary shaft 712 extends in the direction perpendicular to the transport direction of the sheet P. The contact members 714 are cylindrical and rotated by the rotary shaft 712, and the outer peripheral surfaces of the contact members 714 contact the sheet P. The contact members 714 illustrated in FIG. 3A are examples of rotation members. The contact members 714 are disposed at different positions with respect to the direction perpendicular to the transport direction of the sheet P and are arranged in the direction perpendicular to the transport direction of the sheet P. In the present exemplary embodiment, gaps G1 are formed between adjacent contact members 714. The drive roller 702, the belt 704, and the driven roller 710 correspond to a transport unit that transports the sheet P whose leading end abuts against the abutment members 300 further downstream.

The abutment members 300, which are examples of a movement member, are moved downstream in the transport direction of the sheet P by the movement mechanism 700. In the present exemplary embodiment, the transport speed at which the third transport roller 46 (see FIG. 1) transports the sheet P and the movement speed (peripheral speed) of the belt 704 are set such that the transport speed of the sheet P is higher than the movement speed of the belt 704. Therefore, as the sheet P is transported by the third transport roller 46, the sheet P approaches the abutment members 300, and subsequently, the leading end of the sheet P abuts against the abutment members 300. As a result, skew of the sheet P is corrected.

Figure 4A:
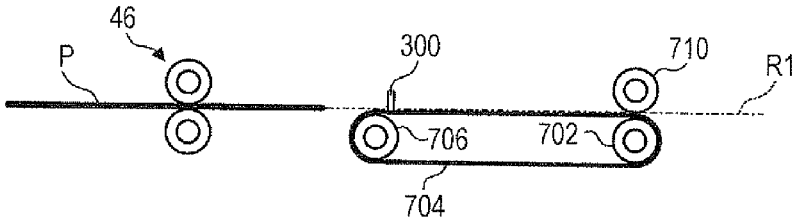
FIGS. 4A to 4F illustrate movements of the members of the mechanism when skew correction is performed.
Figure 4B:
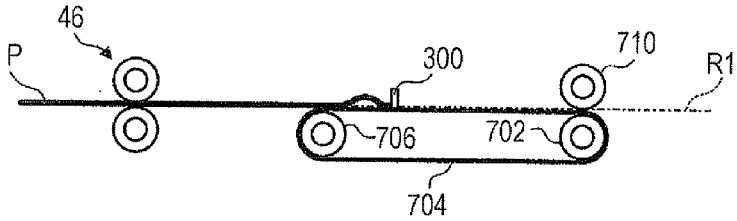
Figure 4C:
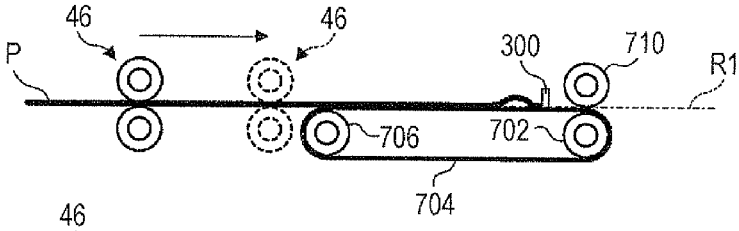

FIGS. 4A to 4F illustrate movements of the members of the movement mechanism 700 when skew correction is performed. First, in the present exemplary embodiment, the sheet P is transported from upstream by the third transport roller 46 as illustrated in FIG. 4A. Next, rotation of the drive roller 702 is started when a sheet detection sensor (not shown) detects the leading end of the sheet P, and movement of the abutment members 300 is started. Subsequently, the leading end of the sheet P abuts against the abutment members 300 as illustrated in FIGS. 4B and 4C, and transportation of the sheet P is continued in this state. Thus, the leading edge of the sheet P is aligned with the direction perpendicular to the transport direction of the sheet P, and thereby skew of the sheet P is corrected.

Figure 4D:
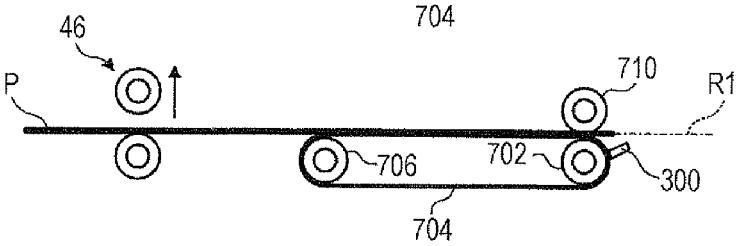

Subsequently, as illustrated in FIG. 4D, the abutment members 300 reach positions beyond the driven roller 710, the sheet P is held (nipped) between the driven roller 710 and the belt 704, and transportation of the sheet P by the driven roller 710 and the belt 704 is started. As illustrated in FIG. 4D, after the transportation of the sheet P by the driven roller 710 and the belt 704 is started, the abutment members 300 are retracted from the first sheet transport path R1 and are separated from the leading end of the sheet P. In the present exemplary embodiment, the leading end of the sheet P is pressed against the abutment members 300 until the sheet P is held (nipped) between the driven roller 710 and the belt 704. In other words, in the present exemplary embodiment, the abutment members 300 are separated from the leading end of the sheet P after the abutment members 300 have passed a nip part between the driven roller 710 and the belt 704.

If the abutment members 300 are separated from the leading end of the sheet P before the sheet P is held between the driven roller 710 and the belt 704, the sheet P may skew again before the leading end reaches the driven roller 710. With the structure according to the present exemplary embodiment, as described above, the leading end of the sheet P is pressed against the abutment members 300 until the sheet P is held between the driven roller 710 and the belt 704. Therefore, the sheet P is prevented from skewing again.

As illustrated in FIG. 4D, in the present exemplary embodiment, one of the pair of roller members of the third transport roller 46 is separated from the other roller member after the sheet P has been held between the driven roller 710 and the belt 704. As described above, in the present exemplary embodiment, the movement speed of the belt 704 is lower than the transport speed at which the third transport roller 46 transports the sheet P. Therefore, in the present exemplary embodiment, it may happen that the sheet P is pressed into the nip part between the driven roller 710 and the belt 704 after the sheet P has been held between the driven roller 710 and the belt 704.

Therefore, as describe above, in the present exemplary embodiment, one of the roller members of the third transport roller 46 is separated from the other roller member after the sheet P has been held between the driven roller 710 and the belt 704. Whether the sheet P has been held between the driven roller 710 and the belt 704 may be determined by detecting the leading end of the sheet P by using a sensor (not shown) that is disposed downstream of the driven roller 710.

Figure 4E:
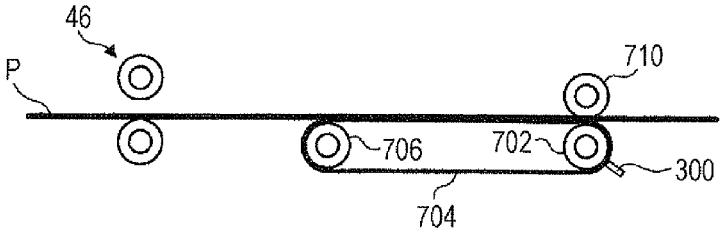
Figure 4F:
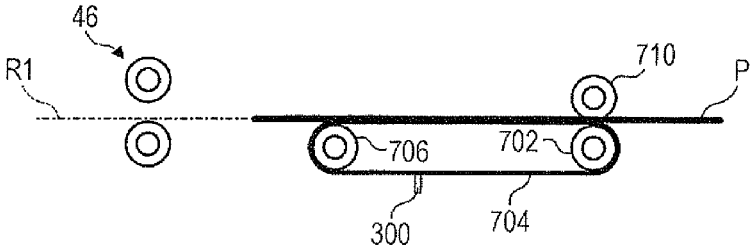

Subsequently, in the present exemplary embodiment, the sheet P is transported further downstream as illustrated in FIGS. 4E and 4F. Then, the sheet P is transported further downstream by the second transport roller 45 (see FIG. 1) and the first transport roller 44. Although not illustrated, in the present exemplary embodiment, after the sheet P has been held (nipped) by the first transport roller 44, one of the roller members of the second transport roller 45 is separated from the other roller member and the driven roller 710 is separated from the belt 704. Although not described above, the present exemplary embodiment includes a sensor for detecting a side edge of the sheet P. In the present exemplary embodiment, the first transport roller 44 that nips the sheet P is moved in the direction perpendicular to the transport direction of the sheet P on the basis of a detection result obtained by the sensor.

Thus, the sheet P passes a predetermined position with respect to the direction perpendicular to the transport direction of the sheet P, and thereby an image is formed at a desired position on the sheet P. In this case, if one of the roller members of the second transport roller 45 is in contact with the other roller member and the driven roller 710 is in contact with the belt 704, the sheet P may not be moved and thereby the sheet P may become damaged. Therefore, in the present exemplary embodiment, the separation operations described above are performed after the sheet P has been held (nipped) by the first transport roller 44. In the present exemplary embodiment, the driven roller 710 is moved and separated from the belt 704. Instead, the belt 704 may be moved and separated from the driven roller 710.

Figure 5:
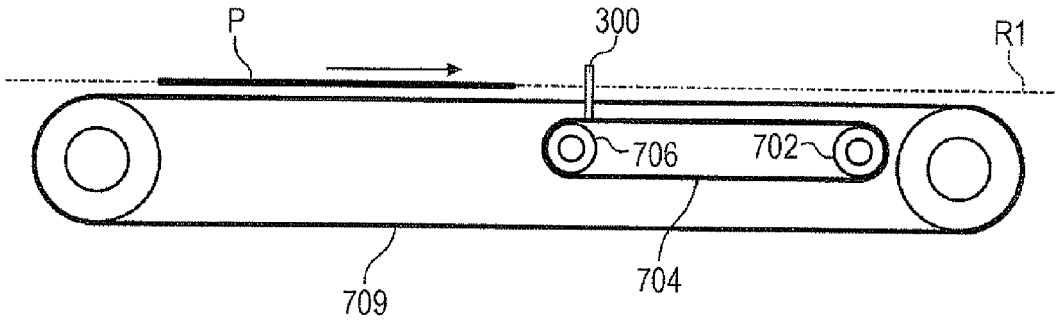
FIG. 5 illustrates a sheet transport system having a different structure.

As illustrated in FIGS. 4B and 4C, in the present exemplary embodiment, only a part (leading end portion) of the sheet P is placed on the belt 704 when skew correction is performed by using the abutment members 300. As illustrated in FIG. 5 (illustrating a system for transporting the sheet P having a different structure), skew correction may be performed while the entirety of the sheet P is placed on and transported by a transport belt 709. In this case, however, frictional resistance is high because the contact area between the sheet P and the transport belt 709 is large, so that the sheet P is not moved smoothly. Thus, skew correction may not be successfully performed in this case. In contrast, with the structure illustrated in FIGS. 4A to 4F, only a part of the sheet P is placed on the belt 704, so that the sheet P is moved smoothly and skew correction is more successfully performed.

A guide member for guiding the sheet P is usually disposed on a side of a transport path of the sheet P. In the structure illustrated in FIG. 4, the guide member may be omitted because the belt 704 also functions as a guide for guiding the sheet P. In this case, the number of components may be reduced. On the other hand, in the structure illustrated in FIG. 5, the transport belt 709, which is disposed outside the belt 704, functions as a guide member. In other words, a member that is different from the belt 704 functions as the guide member, so that the number of components becomes larger than that of the structure illustrated in FIGS. 4A to 4F.

As illustrated in FIG. 3A and other figures, in the case where the abutment members 300 protrude from the outer peripheral surface of the belt 704, parts of the abutment members 300 other than the bottom portions (free end portions) may become displaced upstream or downstream in the transport direction of the sheet P due to inclinations of the abutment members 300. In this case, the abutment members 300 may not be aligned with the direction perpendicular to the transport direction of the sheet P, and skew correction of the sheet P may not be properly performed. On the other hand, the bottom portions of the abutment members 300 are located at predetermined positions even if the abutment members 300 are inclined.

In the structure illustrated in FIGS. 3A, 3B and other figures, the sheet P is placed on the belt 704 to which the abutment members 300 are attached, so that the sheet P abuts against the bottom portions of the abutment members 300. Therefore, in the present exemplary embodiment, skew correction of the sheet P is possible even if parts of the abutment members 300 other than the bottom portions are displaced upstream or downstream in the transport direction of the sheet P. In contrast, in the structure illustrated in FIG. 5, the bottom portions of the abutment members 300 are located inside the transport belt 709, so that it is difficult to make the sheet P abut against the bottom portions of the abutment members 300. In this case, skew correction of the sheet P may not be properly performed.

As described above, in the present exemplary embodiment, the gaps G1 are formed between the contact members 714 of the driven roller 710 (see FIG. 3A), and the abutment members 300 that have reached the driven roller 710 pass through the gaps G1. Subsequently, as illustrated in FIGS. 4E and 4F, the abutment members 300 move upstream in the transport direction of the sheet P and return to the original state (illustrated in FIG. 4A).

After the driven roller 710 has been separated from the belt 704 as described above, the movement speed of the belt 704 may be increased by increasing the number of revolutions of the drive roller 702. In this case, the abutment members 300 return to the state illustrated in FIG. 4A in a shorter time. If the number of revolutions of the drive roller 702 is increased while the driven roller 710 and the belt 704 are in contact with each other, the sheet P is pressed into a nip between the roller members of the second transport roller 45 (see FIG. 1). In the structure in which the driven roller 710 is not separated from the belt 704, the number of revolutions of the drive roller 702 may be increased after the trailing end of the sheet P has passed the nip between the driven roller 710 and the belt 704.

In the present exemplary embodiment, the third transport roller 46, which is disposed upstream of the abutment members 300 and feeds the sheet P toward the abutment members 300, is fixed in place. Alternatively, as illustrated by broken line in FIG. 4C, the third transport roller 46 may be moved downstream, for example, at a speed the same as the movement speed of the abutment members 300. In the exemplary embodiment described above, the distance between the abutment members 300 and the third transport roller 46, which feeds the sheet P toward the abutment members 300, gradually increases. In this case, the sheet P may become buckled between the abutment members 300 and the third transport roller 46, and thereby the contact pressure between the leading end of the sheet P and the abutment members 300 may decrease. In contrast, in the case where the third transport roller 46 is moved, the sheet P does not easily become buckled easily and the contact pressure between the leading end of the sheet P and the abutment members 300 remains high. Therefore, skew correction is more reliably performed.

Skew correction of the sheet P may be performed by making the sheet P abut against the abutment members 300 that do not move. In this case, however, it is necessary to considerably reduce the transport speed of the sheet P or to temporarily stop transportation of the sheet P in order to prevent damage to the sheet P that may be caused when the sheet P abuts against the abutment members 300. Moreover, in this case, the number of the sheets P that are transportable per unit time is reduced and thereby the productivity may be reduced. In contrast, with the structure according to the present exemplary embodiment, because the abutment members 300 move together with the sheet P, skew correction is performed without stopping transportation of the sheet P or reducing the transport speed, so that the productivity is high as compared with the case where the abutment members 300 do not move.

In the structure described above, the abutment members 300 are disposed at one position in the circumferential direction of the belt 704. However, the abutment members 300 may be disposed at plural positions in the circumferential direction. In this case, the abutment members 300 protrude into the first sheet transport path R1 without rotating the belt 704 by 360°, and the productivity is further increased. In the case where the abutment members 300 are disposed at plural positions in the circumferential direction, the distance between the abutment members 300 in the circumferential direction may be adjusted so that the abutment members 300 protrude into the first sheet transport path R1 at one position in the circumferential direction. If, for example, the abutment members 300 protrude into the first sheet transport path R1 at two positions (an upstream position and a downstream position) in the sheet transport direction, it may happen that the sheet P rises above the first sheet transport path R1 due to the abutment members 300 at one of the positions.

Figure 6A:
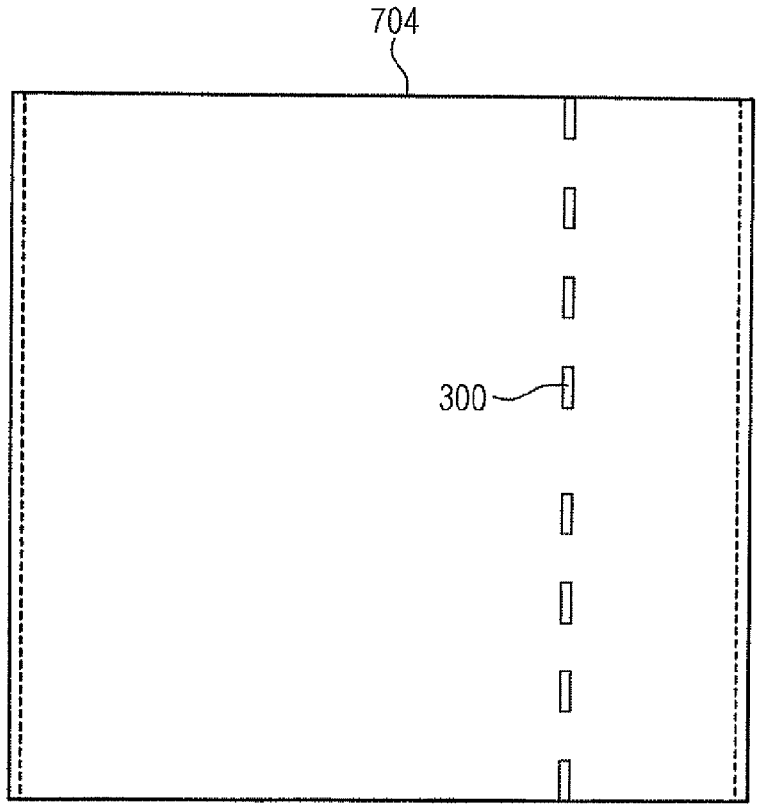
FIGS. 6A and 6B illustrate the structures of a belt and other members.
Figure 6B:
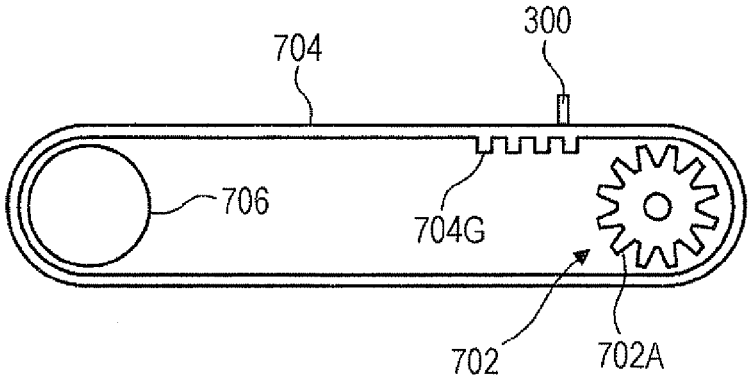

FIGS. 6A and 6B illustrate the structures of the belt 704 and other members. FIG. 6A is a plan view of the belt 704. FIG. 6B is a side view of the belt 704, the drive roller 702, and other members.

Although not described above, teeth 702A are formed in the outer peripheral surface of the drive roller 702. Teeth 704G are formed in the inner peripheral surface of the belt 704. In the present exemplary embodiment, the teeth 702A of the drive roller 702 mesh with the teeth 704G of the belt 704, and thereby a driving force is transmitted from the drive roller 702 to the belt 704. Although the teeth 704G are formed around the entire periphery of the belt 704, some of the teeth 704G are not illustrated in FIG. 6B for ease of drawing.

In the present exemplary embodiment, the number of the teeth 704G of the belt 704 (the number of valleys) is an integer multiple of the number of the teeth 702A of the drive roller 702. The rotation center of the drive roller 702 may be displaced due to an mechanical error or the like. However, in the structure according to the present exemplary embodiment, movement of the abutment members 300 along the first sheet transport path R1 is uniform, and the movement of the abutment members 300 when the sheet P abuts against the abutment members 300 is prevented from becoming different for each sheet P.

If the rotation center of the drive roller 702 is displaced and the number of the teeth 704G of the belt 704 is not an integer multiple of the teeth 702A of the drive roller 702, the phase of rotation of the drive roller 702 when the abutment members 300 move along the first sheet transport path R1 is different for each sheet P. In this case, the movement of the abutment members 300 is different for each sheet P, and for example, the movement speed of the sheet P when the sheet P abuts against the abutment members 300 is different for each sheet P. Moreover, for example, the position of the abutment members 300 when the sheet P abuts against the abutment members 300 is different for each sheet P.

In contrast, when the number of the teeth 704G of the belt 704 is an integer multiple of the number of the teeth 702A of the drive roller 702 as in the present exemplary embodiment, the movement of the abutment members 300 along the first sheet transport path R1 is uniform for each sheet P, so that nonuniformity in the movement speed and the position of the abutment members 300 when the sheet P abuts against the abutment members 300 is prevented. If the abutment members 300 are disposed at plural positions in the circumferential direction of the belt 704 as described above, the number of the teeth 704G between the abutment members 300 that are located at different positions in the circumferential direction may be an integer multiple of the teeth 702A of the drive roller 702.

Figure 7A:
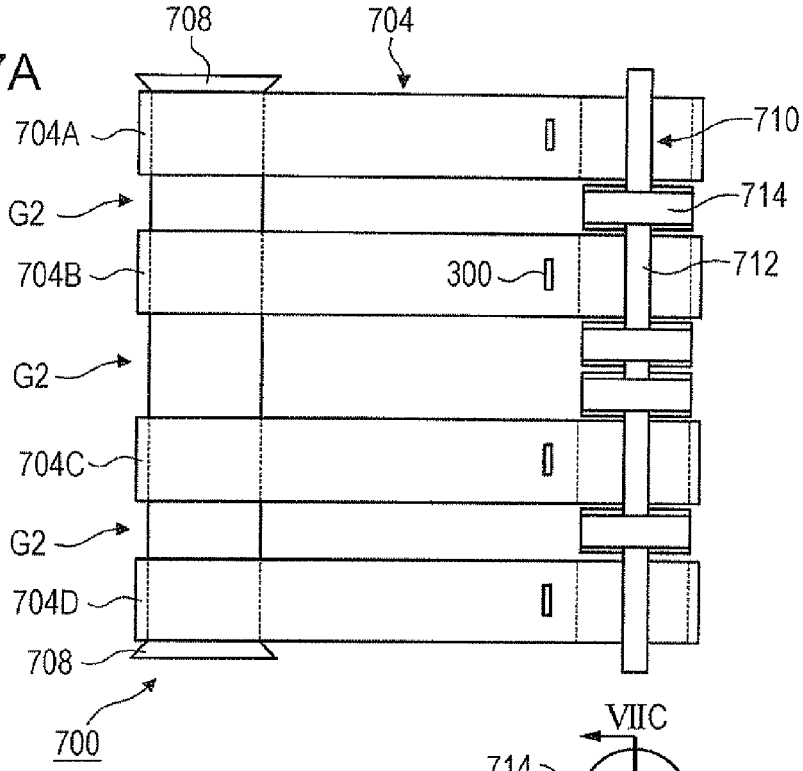
FIGS. 7A to 7C illustrate a movement mechanism for moving the abutment members according to another exemplary embodiment.
Figure 7B:
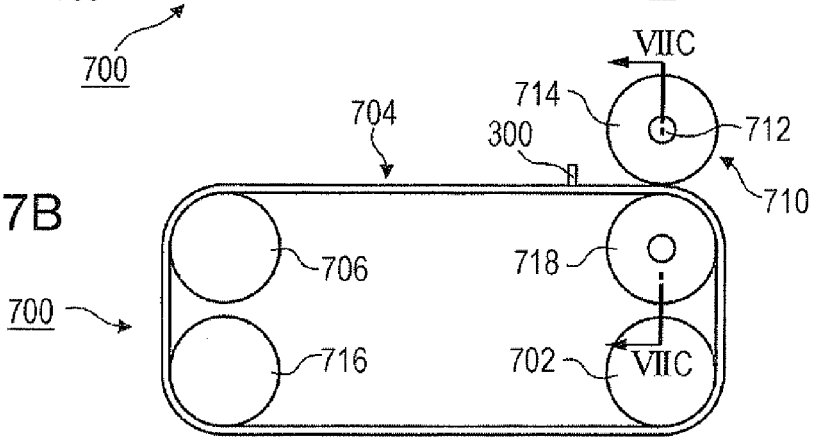
Figure 7C:
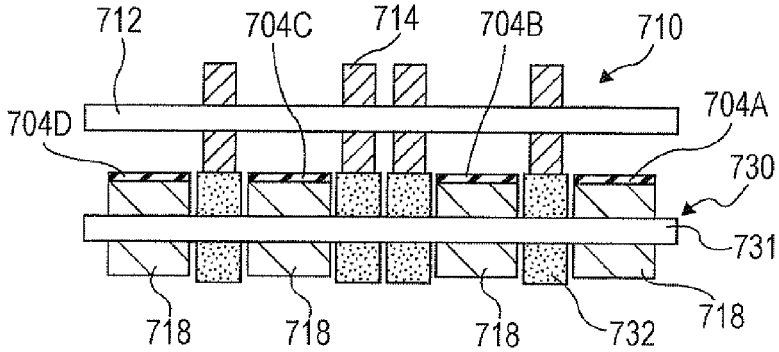

FIGS. 7A to 7C illustrate a movement mechanism 700 for moving the abutment members 300 according to another exemplary embodiment. Members having the same functions as those of the members described above will be denoted by the same numerals and descriptions thereof will be omitted. FIG. 7A is a plan view, and FIG. 7B is a side view. FIG. 7C is a sectional view taken along line VIIC-VIIC of FIG. 7B.

As illustrated in FIG. 7B, the movement mechanism 700 according to the present exemplary embodiment also includes a drive roller 702 and a support roller 706. In addition to the drive roller 702 and the support roller 706, the present exemplary embodiment further includes a first support roller 716 and a second support roller 718 that support a belt 704. The drive roller 702, the support roller 706, the first support roller 716, and the second support roller 718 are disposed at four corners of the substantially rectangular loop of the belt 704.

The drive roller 702 according to the present exemplary embodiment is disposed at a corner that is away from the first sheet transport path R1 and on the downstream side in the transport direction of the sheet P. The second support roller 718 is disposed at a corner between the drive roller 702 and the first sheet transport path R1. The first support roller 716 is disposed at a corner that is away from the first sheet transport path R1 and on the upstream side in the transport direction of the sheet P. The support roller 706 is disposed at a corner that is adjacent to the first sheet transport path R1 and on the upstream side in the transport direction of the sheet P.

In the present exemplary embodiment, the first support roller 716, which is disposed away from the first sheet transport path R1, has the flanges 708 (see FIG. 7A). Although not illustrated, in the present exemplary embodiment, the drive roller 702, which is disposed away from the first sheet transport path R1, has flanges (not shown). Therefore, in the present exemplary embodiment, the flanges 708 do not protrude into the first sheet transport path R1 along which the sheet P is transported, so that the sheet P having a width larger than that of the belt 704 may be transported.

In the present exemplary embodiment, the belt 704 is segmented into four portions that are first to fourth belts 704A to 704D. The first to fourth belts 704A to 704D are arranged in the direction perpendicular to the transport direction of the sheet P. In the present exemplary embodiment, gaps G2 are formed between the first belt 704A and the second belt 704B, between the second belt 704B and the third belt 704C, and between the third belt 704C and the fourth belt 704D. In the present exemplary embodiment, grooves (not shown) for preventing movement of the first to fourth belts 704A to 704D (in the direction perpendicular to the transport direction of the sheet P) are formed in the first support roller 716 and the like. As illustrated in FIG. 7C, in the present exemplary embodiment, four second support rollers 718 are disposed so as to correspond to the first to fourth belts 704A to 704D.

In the present exemplary embodiment, the abutment member 300 is disposed on each of the first to fourth belts 704A to 704D. The positions of the abutment members 300 are adjusted beforehand so that the abutment members 300 are aligned along a straight line that is perpendicular to the transport direction of the sheet P. In the present exemplary embodiment, a driven roller 710 is disposed above the second support roller 718. As with the exemplary embodiment described above, the driven roller 710 includes a rotary shaft 712, which extends in the direction perpendicular to the transport direction of the sheet P, and contact members 714 whose outer peripheral surfaces contact the sheet P.

The contact members 714 are disposed in the gaps G2 formed between the first belt 704A and the second belt 704B, between the second belt 704B and the third belt 7040, and between the third belt 704C and the fourth belt 704D. As illustrated in FIG. 7C, the present exemplary embodiment includes a transport roller 730 that is rotated by a motor (not shown) and that transports the sheet P, which has been transported from upstream, in the downstream direction in corporation with the driven roller 710.

The transport roller 730 includes a rotary shaft 731 and contact members 732. The rotary shaft 731 is rotated by a motor. The contact members 732 are cylindrical and rotated by the rotary shaft 731, and the outer peripheral surfaces of the contact members 732 contact the sheet P. The contact members 714 of the driven roller 710 are pressed against the driven roller 710. The sheet P that has been transported from upstream is nipped between the contact members 714 of the driven roller 710 and the contact members 732 of the transport roller 730, and is transported downstream. As illustrated in FIG. 7C, the second support rollers 718 are supported by the rotary shaft 731 of the transport roller 730. To be specific, a bearing (not shown) is disposed between the second support roller 718 and the rotary shaft 731, and thereby the second support roller 718 is supported by the rotary shaft 731 so as to be rotatable around the rotary shaft 731.

In the present exemplary embodiment, the transport speed at which the transport roller 730 transports the sheet P is equal to the movement speed of the abutment members 300 (the peripheral speed of the outer peripheral surface of the belt 704). If the transport speed at which the transport roller 730 transports the sheet P is lower than the movement speed of the abutment members 300, the sheet P abuts against the transport roller 730, and the leading end (leading edge) of the sheet P follows the alignment of the transport roller 730. That is, although skew of the sheet P has been corrected by using the abutment members 300, the sheet P may skew again when the sheet P abuts against the transport roller 730. Therefore, in the present exemplary embodiment, the transport speed at which the transport roller 730 transports the sheet P is set equal to the movement speed of the abutment members 300 as described above. Alternatively, the transport speed at which the transport roller 730 transports the sheet P may be set higher than the movement speed of the abutment members 300.

As with the case described above, the driven roller 710 may be separable from the transport roller 730. The number of revolutions of the drive roller 702 and the movement speed of the belt 704 may be increased after the driven roller 710 has been separated from the transport roller 730. As with the case described above, the number of revolutions of the drive roller 702 may be increased after the trailing end of the sheet P has passed the nip between the driven roller 710 and the belt 704.

FIGS. 8A to 8D are enlarged views each illustrating an exemplary structure of each abutment member 300 and a region surrounding the abutment member 300.

Figure 8A:
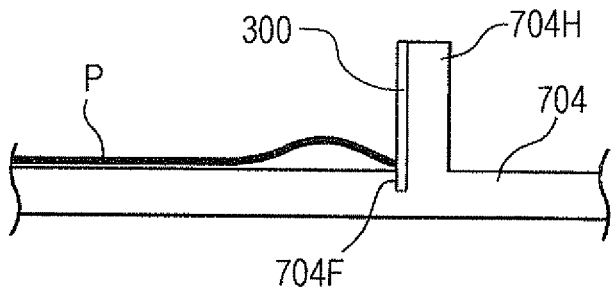
FIGS. 8A to 8D are enlarged views each illustrating an exemplary structure of each abutment member and a region surrounding the abutment member.

As illustrated in FIG. 8A, the abutment member 300 according to the present exemplary embodiment is inserted into a recess 704F formed in the belt 704. Therefore, in the present exemplary embodiment, an end portion of the abutment member 300 is embedded in the belt 704.

The abutment member 300 may be fixed to the belt 704 by bonding an end surface of the abutment member 300 to the outer peripheral surface of the belt 704. In this case, however, the abutment member 300 may be easily removed from the belt 704. Moreover, in this case, a gap may be formed between the outer peripheral surface of the belt 704 and the abutment member 300. If such a gap is formed, the leading end of the sheet P may enter the gap, and transportation of the sheet P may become difficult. Therefore, in the present exemplary embodiment, the end of the abutment member 300 is embedded in the belt 704.

In the structure illustrated in FIG. 8A, a protrusion 704H that protrudes in a direction away from the outer peripheral surface of the belt 704 is formed on the belt 704. In the present exemplary embodiment, the abutment member 300 is supported by the protrusion 704H. To be specific, the back surface of the abutment member 300 is bonded to the protrusion 704H with an adhesive. When the abutment member 300 is supported by the protrusion 704H in this way, inclination of the abutment member 300 upstream or downstream in the transport direction of the sheet P is reduced as compared with the case where the protrusion 704H is not provided.

Figure 8B:
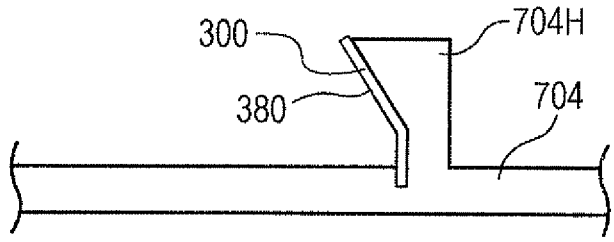

As illustrated in FIG. 8B, an abutment surface 380 of the abutment member 300 against which the sheet P abuts may be inclined upward in FIG. 8B and upstream in the transport direction of the sheet P. In other words, the abutment surface 380 may be inclined such that the farther a position on the abutment surface 380 from the outer peripheral surface of the belt 704 is, the more upstream the position is in the transport direction of the sheet P. In FIG. 8B, a part of the abutment surface 380 (a part away from the belt 704) is inclined. Alternatively, the entirety of the abutment surface 380 may be inclined. In the case where the abutment surface 380 is inclined, even if the leading end of the sheet P rises above the surface of the belt 704, the leading end of the sheet P is moved (guided) toward the belt 704 along the abutment surface 380. In this case, the probability is increased that the leading end of the sheet P abuts against the bottom portion of the abutment member 300 and the sheet P is not easily displaced upstream or downstream in the transport direction.

Figure 8C:
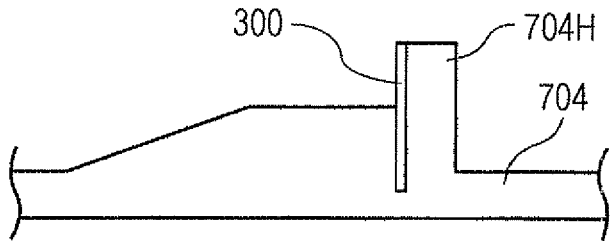
Figure 8D:
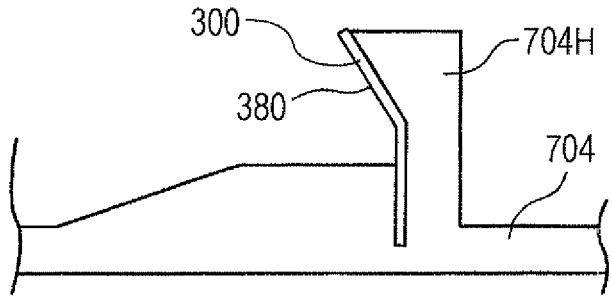

If the thickness of the belt 704 is small, the depth of the recess 704F (see FIG. 8A) is small and the abutment member 300 may be easily removed. Therefore, for example, as illustrated in FIG. 8C, the thickness of a part of the belt 704 to which the abutment member 300 is attached may be made larger than the thickness of the remaining part of the belt 704. As illustrated in FIG. 8D, the thickness of the belt 704 may be increased and the abutment surface 380 may be inclined. If the thickness of a part of the belt 704 is increased, a step may be formed on the belt 704 and the step may restrict transportation of the sheet P. Therefore, in FIGS. 8C and 8D, the thickness of the belt 704 is gradually increased from upstream toward downstream in the transport direction of the sheet P so that a step may not be formed.

Figure 9:
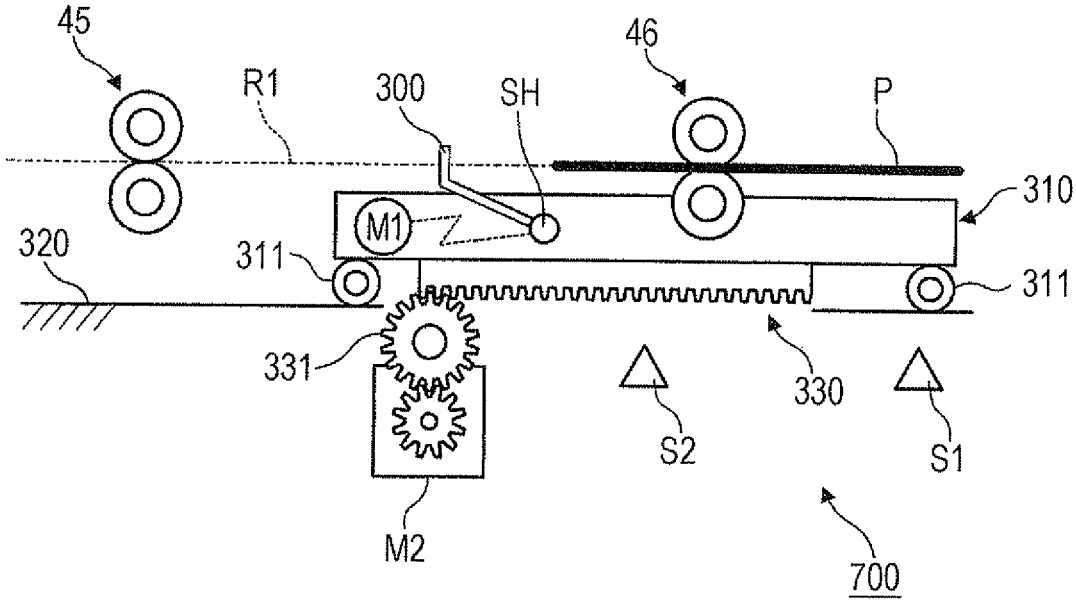
FIG. 9 illustrates a movement mechanism for moving the abutment members according to another exemplary embodiment.

FIG. 9 illustrates a movement mechanism 700 for moving the abutment members 300 according to another exemplary embodiment. FIG. 9 illustrates the movement mechanism 700 as seen from the rear of the image forming apparatus 100.

As illustrated in FIG. 9 and as described above, the abutment members 300 are disposed between the second transport roller 45 and the third transport roller 46. Each of the abutment members 300 according to the present exemplary embodiment is L-shaped and protrudes into the first sheet transport path R1 as in the exemplary embodiment described above. The movement mechanism 700 according to the present exemplary embodiment includes a carriage 310 that is movable in the transport direction of the sheet P and that supports the abutment members 300. Moreover, a support table 320 for supporting the carriage 310 from below is provided.

The carriage 310, which is an example of a mobile body, includes a shaft SH that supports ends of the abutment members 300. The shaft SH is rotatable, and the abutment members 300 rotate (swing) around the shaft SH. The carriage 310 includes a motor M1 that rotates the shaft SH. A rack gear 330 is formed on a part of the carriage 310 that faces the support table 320. The carriage 310 includes wheels 311 that are supported by the support table 320. The present exemplary embodiment includes a pinion gear 331 that meshes with the rack gear 330 and a motor M2 that rotates the pinion gear 331. A first sensor S1 and a second sensor S2 for detecting the carriage 310 are disposed at different positions in the transport direction of the sheet P.

FIGS. 10A to 10F illustrate movements of the abutment members 300 and other members. Referring to FIGS. 9 and 10A to 10F, the movements of these members will be described.

Figure 10A:
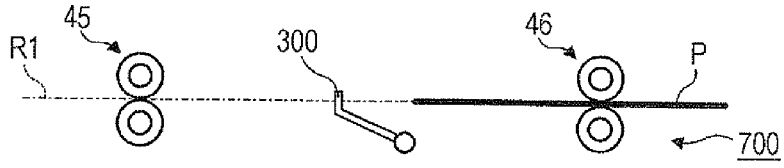
FIGS. 10A to 10F illustrate movements of the abutment members and other members.
Figure 10B:
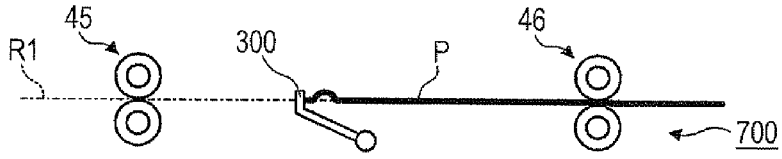
Figure 10C:
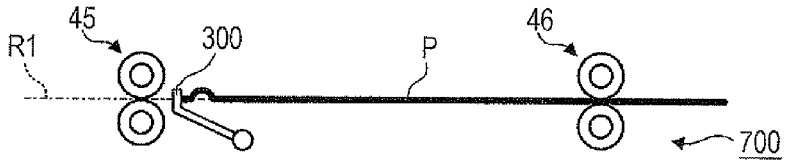

When the leading end of the sheet P is detected by a sheet detection sensor (not shown), the motor M2 is driven and the carriage 310 is started to be moved downstream in the transport direction of the sheet P. The movement speed of the carriage 310 is lower than the transport speed at which the third transport roller 46 transports the sheet P. Subsequently, as illustrated in FIG. 10B, the leading end of the sheet P abuts against the abutment members 300, and transportation of the sheet P is continued in this state (see FIG. 10C). Thus, the leading edge of the sheet P is aligned with the direction perpendicular to the transport direction of the sheet P, and skew of the sheet P is corrected.

Figure 10D:
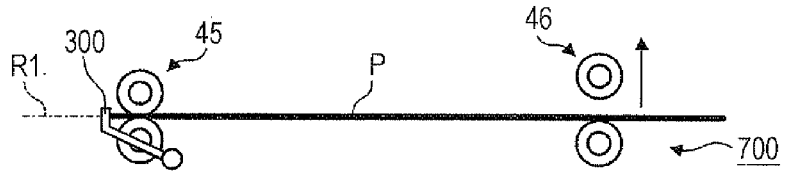
Figure 10E:
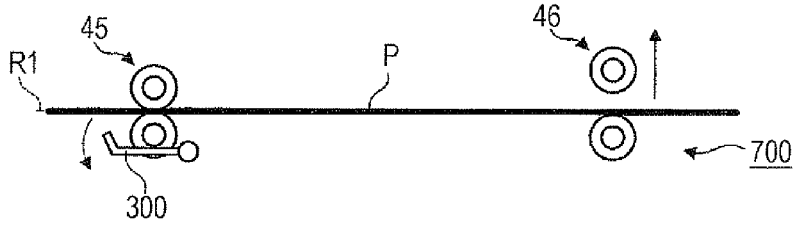
Figure 10F:
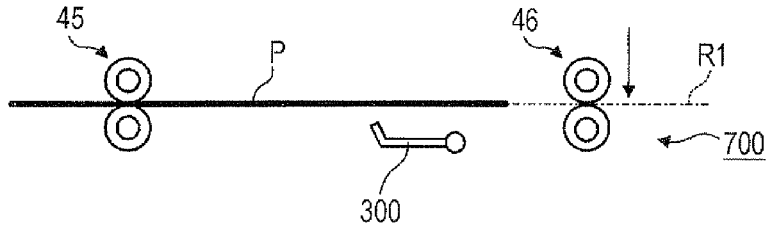

Subsequently, as illustrated in FIG. 10D, the abutment members 300 reach the second transport roller 45, and the sheet P is held (nipped) by the second transport roller 45. Next, the motor M1 is driven. Thus, as illustrated in FIG. 10E, the abutment members 300 rotate downward, and the abutment members 300 are moved to positions away from the first sheet transport path R1. Subsequently, as illustrated in FIGS. 10E and 10F, the sheet P is transported further downstream by the second transport roller 45. In the present exemplary embodiment, the abutment members 300 are rotated by the motor M1. Alternatively, a guide rail (not shown) for guiding the abutment members 300 may be disposed on a side of the first sheet transport path R1 or the like, and the abutment members 300 may be rotated by using the guide rail.

As with the driven roller 710 described above (see FIG. 3A), the second transport roller 45 according to the present exemplary embodiment includes contact members 714 (not illustrated in FIGS. 9 and 10A to 10F). Gaps G1 (see FIG. 3A) are formed between adjacent contact members 714 (not illustrated in FIGS. 9 and 10A to 10F). In the present exemplary embodiment, as with the exemplary embodiment described above, the abutment members 300 that have reached the second transport roller 45 pass through the gaps G1 formed in the second transport roller 45. As illustrated in FIG. 10D, also in the present exemplary embodiment, one of the roller members of the third transport roller 46 is separated from the other roller member after the sheet P has been held (nipped) by the second transport roller 45.

In the present exemplary embodiment, the carriage 310 is not detected by the second sensor S2 (see FIG. 9) after the abutment members 300 have reached the second transport roller 45. At this time, the motor M2 is reversed, and the carriage 310 moves upstream in the transport direction of the sheet P. When the carriage 310 is detected by the first sensor S1, rotation of the motor M2 is stopped and the carriage 310 is stopped. Thus, the abutment members 300 return to predetermined positions that are upstream of the second transport roller 45. In the present exemplary embodiment, the motor M1 is reversed while the carriage 310 is moving upstream. Thus, the abutment members 300 protrude into the first sheet transport path R1 again.

Also with the structure according to the present exemplary embodiment, skew correction of the sheet P is performed without stopping transportation of the sheet P, and thereby the productivity is increased. In the structure according to the present exemplary embodiment, increase in the size of the apparatus may be prevented. In the structure using the belt 704 illustrated in FIGS. 7A to 7C and other figures, the size of the apparatus may become large because it is necessary to provide a space for a forward path along which the belt 704 moves downstream and a space for a return path along which the belt 704 moves upstream. In contrast, in the structure illustrated in FIG. 9, the size of the apparatus may be small because the carriage 310 reciprocates along a single path.

FIGS. 11A to 11F illustrate a movement mechanism 700 according to another exemplary embodiment.

In the exemplary embodiment described above, the third transport roller 46 may be moved downstream so that the contact pressure between the leading end of the sheet P and the abutment members 300 is increased (see FIG. 4C). In the structure according to the present exemplary embodiment, a movable roller 49 that moves in the transport direction of the sheet P is disposed between the second transport roller 45 and the third transport roller 46. The contact pressure between the leading end of the sheet P and the abutment members 300 is increased by using the movable roller 49. The movable roller 49 may be attached to the carriage 310 (see FIG. 9) and moved together with the carriage 310, or may be moved independently from the carriage 310.

Figure 11A:
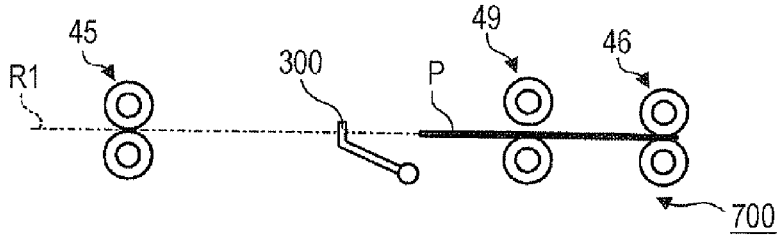
FIGS. 11A to 11F illustrate a movement mechanism according to another exemplary embodiment.
Figure 11B:
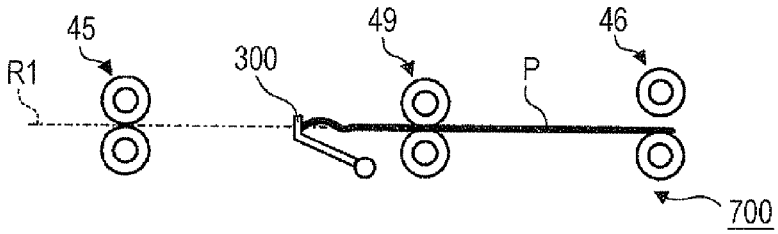
Figure 11C:
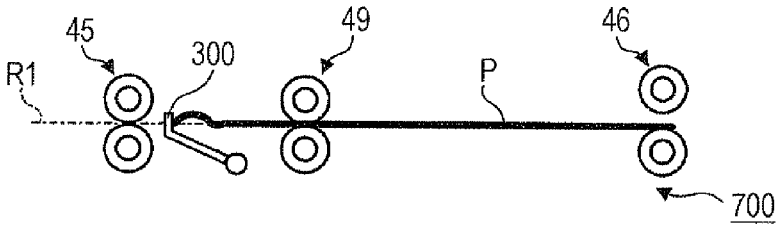

As illustrated in FIG. 11A, when the sheet P is transported to the movement mechanism 700, one of the roller members of the movable roller 49 is retracted from the other roller member, so that these roller members are separated from each other. In the present exemplary embodiment, as in the exemplary embodiment described above, the leading end of the sheet P is detected by a sheet detection sensor (not shown). When the leading end is detected, as illustrated in FIG. 11B, the one of the roller members contacts the other roller member, and the sheet P is held by the movable roller 49. When the sheet P is held in this way, as illustrated in FIG. 11B, the one of the roller members of the third transport roller 46 is separated from the other roller member.

Figure 11D:
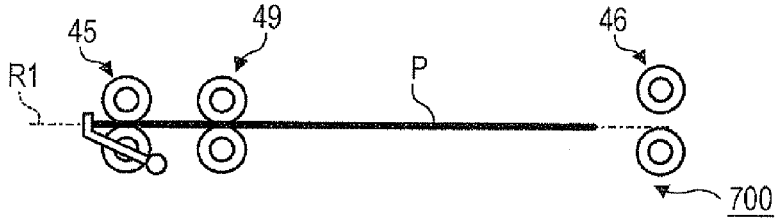
Figure 11E:
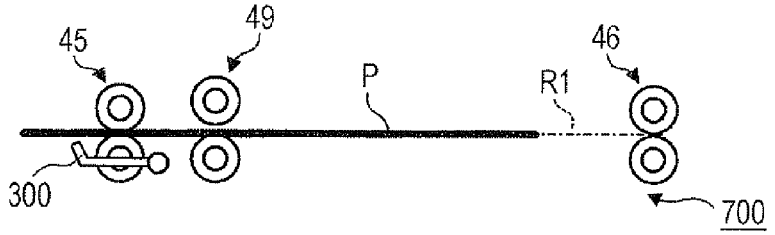
Figure 11F:
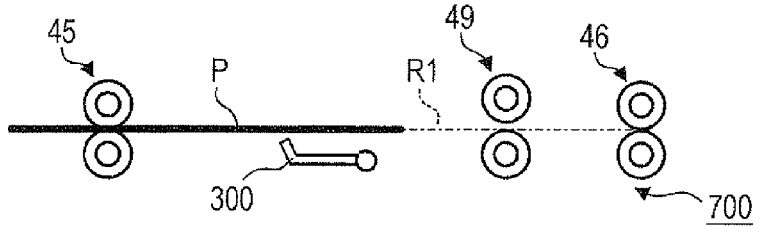

Subsequently, the movable roller 49 and the abutment members 300 move downstream (see FIG. 11C), and the movable roller 49 rotates and makes the sheet P abut against the abutment members 300. Thus, skew of the sheet P is corrected as in the case described above. Subsequently, as illustrated in FIG. 11D, the abutment members 300 reach the second transport roller 45, and the sheet p is held by the second transport roller 45. After the sheet P has been held by the second transport roller 45, as illustrated in FIG. 11E, the abutment members 300 are retracted from the first sheet transport path R1, and one of the roller members of the movable roller 49 is separated from the other roller member. Subsequently, as described above, the motor M2 (see FIG. 9) is reversed and the state of the movement mechanism 700 returns to the state illustrated in FIG. 11A.

Figure 12A:
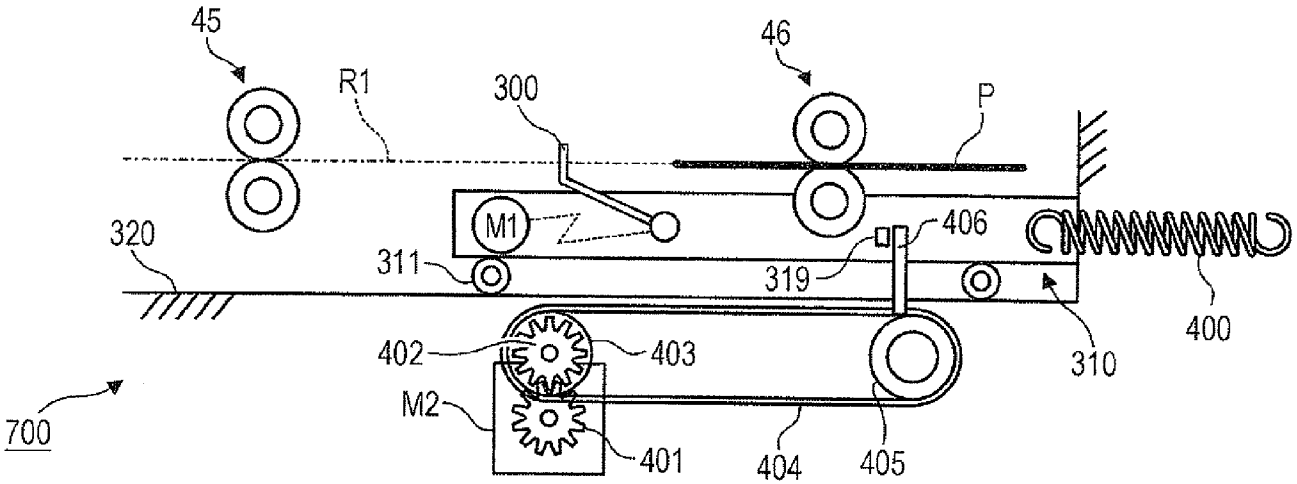
FIGS. 12A and 12B illustrate a movement mechanism according to another exemplary embodiment.
Figure 12B:
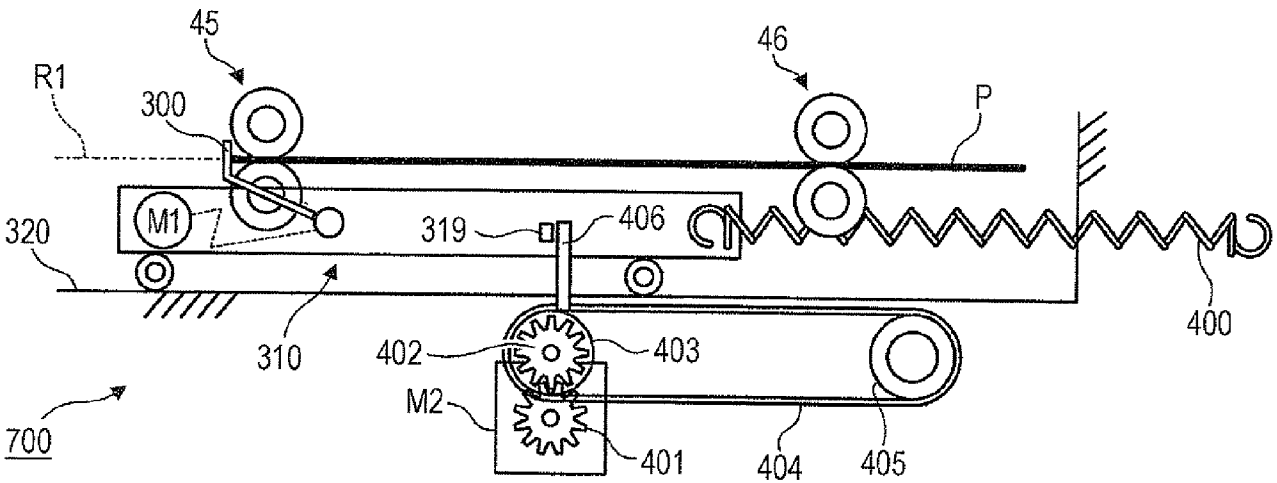

FIGS. 12A and 12B illustrate a movement mechanism 700 according to another exemplary embodiment. Members having the same functions as those of the members described above will be denoted by the same numerals and descriptions thereof will be omitted.

In the present exemplary embodiment, the movement mechanism 700 includes a coil spring 400 for pulling a carriage 310 upstream in the transport direction of the sheet P. The carriage 310 is moved upstream by the coil spring 400. In the present exemplary embodiment, the movement mechanism 700 includes a drive gear 401, a roller 403, an endless belt 404, and a support roller 405. The drive gear 401 is rotated by a motor M2. The roller 403 has a driven gear 402 that meshes with the drive gear 401. The endless belt 404 is rotated by the roller 403. The support roller 405 applies a predetermined tension to the belt 404 and supports the belt 404 from the inside.

The movement mechanism 700 further includes a pressing member 406. The pressing member 406 is attached to the outer peripheral surface of the belt 404 so as to protrude into the movement path of the carriage 310, and presses the carriage 310. The carriage 310 has a protrusion 319 formed on a side surface thereof, and the protrusion 319 is pressed by the pressing member 406. As illustrated in FIG. 12B, in the present exemplary embodiment, the pressing member 406 moves downstream as the motor M2 rotates, and the carriage 310 moves downstream due to the movement of the pressing member 406. As the carriage 310 moves, the abutment members 300 move downstream. At this time, the sheet P, which moves at a speed higher than that of the carriage 310, abuts against the abutment members 300, and skew of the sheet P is corrected.

The carriage 310 is moved upstream (the carriage 310 is returned upstream) as the pressing member 406 moves further downstream from the state illustrated in FIG. 12B. In this case, the pressing member 406 presses the carriage 310 further, and when the pressing member 406 reaches a predetermined position, the pressing member 406 rotates around the roller 403 and is retracted from the movement path of the carriage 310. Thus, the carriage 310 is released from the pressure applied by the pressing member 406, and the carriage 310 is moved upstream by the coil spring 400. Due to the movement of the carriage 310, the abutment members 300 are moved upstream.

Figure 13A:
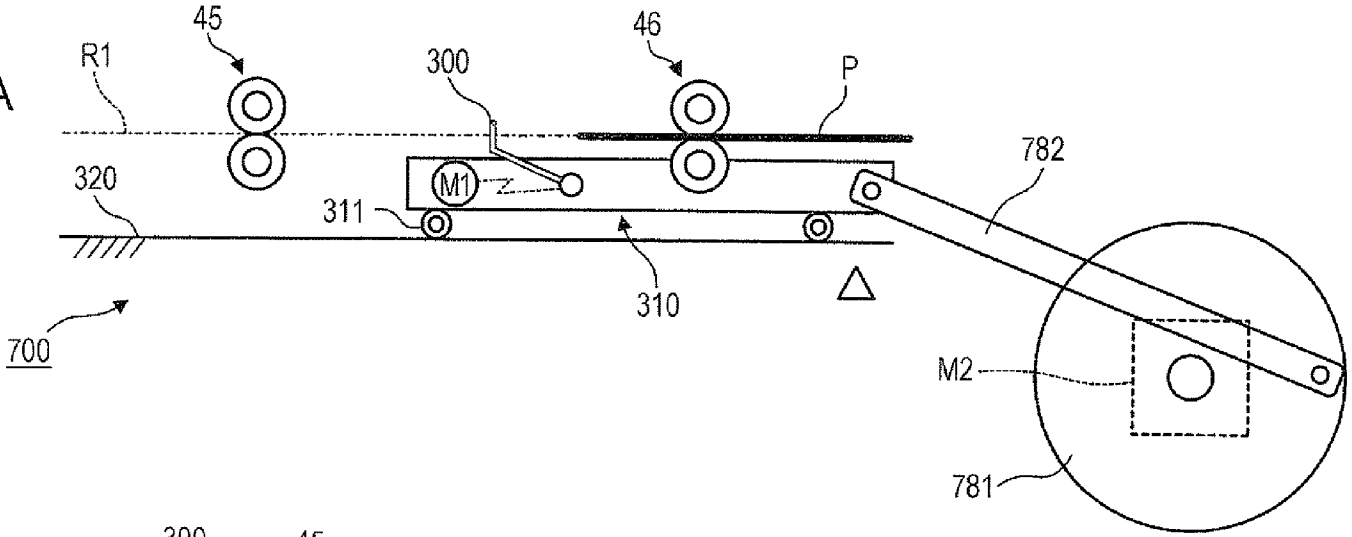
FIGS. 13A and 13B illustrate a movement mechanism according to another exemplary embodiment.
Figure 13B:
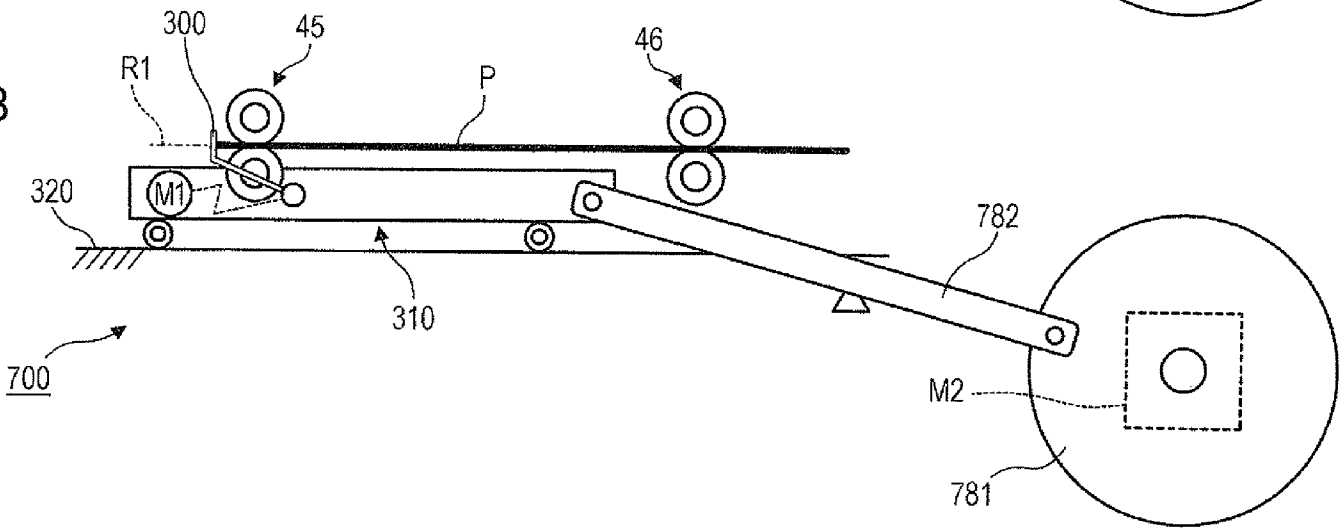

FIGS. 13A and 13B illustrate a movement mechanism according to another exemplary embodiment.

In the present exemplary embodiment, the abutment members 300 are moved by using a linkage mechanism. To be specific, the movement mechanism 700 illustrated in FIGS. 13A and 13B includes a motor M2 and a disk-shaped rotary plate 781 rotated by the motor M2. The movement mechanism 700 includes a linkage member 782 that connects a carriage 310 and the rotary plate 781 to each other. A first end of the linkage member 782 is attached to a position of the rotary plate 781 that is displaced from the rotation center and a second end of the linkage member 782 is attached to the carriage 310. The present exemplary embodiment further includes a guide member (not shown) for guiding movement (displacement) of the linkage member 782. In the present exemplary embodiment, the second end of the linkage member 782 reciprocates in the transport direction of the sheet P as the rotary plate 781 rotates. Due to the reciprocation of the second end of the linkage member 782, the carriage 310 is moved. Due to the movement of the carriage 310, the abutment members 300 are moved in the transport direction of the sheet P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport device comprising:

an abutment member that moves downstream in a sheet transport direction and against which a leading end of a sheet that has been transported from upstream in the sheet transport direction abuts; and a transport unit that includes a pair of rotation members arranged across a sheet transport path from each other and that transports the sheet whose leading end has abutted against the abutment member by nipping the paper further downstream, wherein the abutment member moves from upstream of the transport unit toward the transport unit and reaches the transport unit while the leading end of the sheet abuts against the abutment member, and the abutment member is separated from the leading end of the sheet after the leading end of the sheet is nipped between the pair of rotation members.

2. A sheet transport device comprising:

an abutment member that moves downstream in a sheet transport direction and against which a leading end of a sheet that has been transported from upstream in the sheet transport direction abuts; and a transport unit that transports the sheet whose leading end has abutted against the abutment member further downstream, wherein the abutment member moves from upstream of the transport unit toward the transport unit and reaches the transport unit without stopping while the leading end of the sheet abuts against the abutment member, and the abutment member is separated from the leading end of the sheet after the transport unit has started to transport the sheet.

3. A sheet transport device comprising:

an abutment member that moves downstream in a sheet transport direction and against which a leading end of a sheet that has been transported from upstream in the sheet transport direction abuts;

a transport unit that transports the sheet whose leading end has abutted against the abutment member further downstream; and a belt member that is disposed upstream of the transport unit and transports the sheet thereon, wherein the abutment member is attached to a surface of the belt and moves at least to the transport unit in a state in which the leading end of the sheet abuts against the abutment member, and the abutment member is separated from the leading end of the sheet after the transport unit has started to transport the sheet.

4. The sheet transport device of claim 1, wherein the transport unit includes a plurality of pairs of rotation members that are arranged at different positions in a direction that intersects the sheet transport direction, and the abutment member passes through the gaps formed between the pairs of rotation members.

5. The sheet transport device of claim 1, further comprising:

a pair of rollers that (i) are disposed across the sheet transport path from each other upstream of the abutment member, (ii) transport the sheet toward the abutment member by nipping the paper and making the sheet abut against the abutment member, and (iii) move downstream in the sheet transport direction while the sheet is nipped between the pair of rollers when the abutment unit transports the sheet toward the abutment member.

6. The sheet transport device of claim 2, further comprising:

a pair of rollers that (i) are disposed across the sheet transport path from each other upstream of the abutment member, (ii) transport the sheet toward the abutment member by nipping the paper and making the sheet abut against the abutment member, and (iii) move downstream in the sheet transport direction while the sheet is nipped between the pair of rollers when the abutment unit transports the sheet toward the abutment member.

7. The sheet transport device of claim 3, further comprising:

a pair of rollers that (i) are disposed across the sheet transport path from each other upstream of the abutment member, (ii) transport the sheet toward the abutment member by nipping the paper and making the sheet abut against the abutment member, and (iii) move downstream in the sheet transport direction while the sheet is nipped between the pair of rollers when the abutment unit transports the sheet toward the abutment member.

8. The sheet transport device of claim 4, further comprising:

a pair of rollers that (i) are disposed across the sheet transport path from each other upstream of the abutment member, (ii) transport the sheet toward the abutment member by nipping the paper and making the sheet abut against the abutment member, and (iii) move downstream in the sheet transport direction while the sheet is nipped between the pair of rollers when the abutment unit transports the sheet toward the abutment member.

* * * * *